US008770565B2

(12) United States Patent
Liu et al.

(10) Patent No.: US 8,770,565 B2
(45) Date of Patent: Jul. 8, 2014

(54) JIG FOR SURFACE TREATMENT

(75) Inventors: Huai-Gang Liu, Taipei Hsien (TW); Chih-Peng Chen, Taipei Hsien (TW)

(73) Assignee: Wistron Corporation, Taipei Hsien (TW)

( * ) Notice: Subject to any disclaimer, the term of this patent is extended or adjusted under 35 U.S.C. 154(b) by 0 days.

(21) Appl. No.: 13/472,847

(22) Filed: May 16, 2012

(65) Prior Publication Data

US 2012/0299231 A1 Nov. 29, 2012

(30) Foreign Application Priority Data

May 23, 2011 (TW) ..... 100118036 A

(51) Int. Cl.
*B23Q 1/00* (2006.01)

(52) U.S. Cl.
USPC ..... 269/46; 269/47; 269/48; 269/48.1; 269/48.4; 269/52

(58) Field of Classification Search
USPC ..... 269/46, 47, 48.1, 48.4, 52
See application file for complete search history.

(56) References Cited

U.S. PATENT DOCUMENTS 3,458,166 A * 7/1969 Lanz ..... 248/218.2
4,394,909 A * 7/1983 Valiulis et al. ..... 211/59.1
6,932,334 B1 * 8/2005 Gregory ..... 269/46

* cited by examiner

*Primary Examiner* — Lee D Wilson
*Assistant Examiner* — Shantese McDonald
(74) *Attorney, Agent, or Firm* — Muncy, Geissler, Olds & Lowe, P.C.

(57) ABSTRACT

The present disclosure provides a jig for surface treatment, which is used for fixing a metal plate having a bearing for surface treatment. The jig for surface treatment according to the present disclosure passes a hanging rod through the metal plate. Thereby, the jig for surface treatment will not contact with a processed surface of the metal plate and hence making no apparent flaws on the processed surface and maintaining completeness processed surface. In addition, the jig for surface treatment can load a plurality of metal plates at a time, performing surface treatment on the plurality of metal plates simultaneously, and thus improving productivity and practicability.

20 Claims, 9 Drawing Sheets

JIG FOR SURFACE TREATMENT

FIELD OF THE DISCLOSURE

The present disclosure relates generally to a jig, and particularly to a jig for fixing a metal plate having a bearing and for surface treatment.

BACKGROUND OF THE DISCLOSURE

Nowadays, 3C products are undergoing increasingly prosperous development. Their prices are lowered to the extent that people can afford. Thereby, 3C products own a substantially large consumer market. While consumers are selecting 3C products, in addition to the depicted functions and specifications, the appearance of the 3C products is the first the consumers can feel and influences their purchasing intentions, making it extremely important for the 3C products. In order to make their appearance complete, surface treatment is indispensable.

Surface treatment appeals people's attention, because during the process of manufacturing, transportation, and storage, the surface usually has oxide films, rust, residual molding sand, solder dross, dust, oil, and other residues. For adhering coating materials securely on the surface of a material, it is necessary to clean the surface before coating. Otherwise, not only the adherence of the coating to the metal and the anti-corrosiveness are affected but also the base metal will still continue to be corroded even having the protection of the coating layer, and hence the coating layer will peel off and affecting the mechanical properties and lifetime of the material. Thereby, the surface treatment before coating on materials is a protection layer for ensuring excellent quality. It also extends the lifetime of products and guarantees complete and beautiful appearance.

Surface treatment for materials is always an important subject for the appearance of 3C products. Presently, there are vapor deposition, anode, and etching methods for surface treatment. The vapor deposition treatment heats the material to be vapor-deposited to vaporization in a vacuum chamber and makes the vapor adhere to the surface of a substrate placed nearby and thus forming a thin film. The anode treatment places a metal workpiece on the anode in an electrobath and applies a fixed voltage and current for forming a high-quality oxide layer adhered to the surface of the workpiece. Thereby, the mechanical properties of the surface are improved, and various hues are generated for enhancing appearance. The etching treatment removes materials using chemical reactions or physical bombardment. According to the processing methods, there are wet etching and dry etching. In wet etching, a chemical solution is used and etching is achieved via chemical reactions. On the other hand, dry etching is usually plasma etching. The atoms on the surface of a thin film are removed through the chemical reactions between the chemical solution or plasma and the material to be etched and hence achieving the purpose of etching.

According to prior art, while adopting these methods for surface treatment, in order to avoid shakes of the material due to the flows of chemical solutions during the process, it is required to use a corresponding jig for clipping the material. Nevertheless, owing to the structural design of the jig, the clipping points on the surface of the material appear flaws. In addition, other flaws caused by scraping, colliding, and sliding of the jig may also occur. Current jigs clip at multiple points on the edges for fixing. In this way, untreated flaws at the clipping parts appear, leading to unevenness at the appearance. To solve the problem, it is proposed to dispose hanging points on the material and surface treatment can be performed after the material is fixed by passing therethrough. However, after surface treatment, it is required to organize or clear the hanging points and thus increasing manufacturing procedures and costs. Besides, if the material id thicker than 1 mm, it is not possible to dispose hanging points.

Accordingly, particularly for materials having a bearing, the present disclosure provides a jig for surface treatment adopting an axle fixing method. While treating chemically the surface of the material, hang the material on the jig for surface treatment by using the bearing the material has originally. Thereby, it is necessary to dispose hangers particularly in order to fix the material. The flaws caused by chemical treatment will not be apparent because the contacting portion between the material and the jig is located inside and invisible; the manufacturing procedure and costs will not increase. In addition, according to the present disclosure, the hanging rod of the jig for surface treatment is disposed vertically. When the material is hung, it directs outwards and the portion submerged inside the jig is extremely small. Thereby, the loading capacity is significantly increased and hence concretely enhancing productivity and practicability.

SUMMARY

An objective of the present disclosure is to provide a jig for surface treatment used for processing the surface of a metal plate having a bearing. Because the jig for surface treatment adopts an axle method for fixing the metal plate, a processed surface of the metal plate will not contact with the jig for surface treatment. After the surface chemical process is completed, the metal plate will not have apparent flaws caused by scraping, colliding, and sliding by the jig for surface treatment. Thus, the processed surface of the metal plate is maintained complete after surface treatment.

Another objective of the present disclosure is to provide a jig for surface treatment used for processing the surface of a metal plate having a bearing. While processing, because the material is hung on the jig for surface treatment by using the bearing the material has originally, the jig for surface treatment will not contact with the processed surface of the metal plate, and hence maintaining completeness thereof. Thereby, it is not necessary to add hanging points and hence saving manufacturing procedures and costs.

Still another objective of the present disclosure is to provide a jig for surface treatment used for processing the surface of a metal plate having a bearing. According to the present disclosure, the metal plate is fixed vertically and hung outwards. Thereby, the loading capacity is significantly increased and productivity and practicability are improved.

A further objective of the present disclosure is to provide a jig for surface treatment used for processing the surface of a plurality of metal plates having a bearing. According to the present disclosure, the plurality of metal plates are fixed vertically, which facilitates chemical solutions to flow rapidly while processing the surface chemically so that the plurality of metal plates will not collide with each other and thus avoiding subsequent processing procedures and costs.

For achieving the objectives described above, the present disclosure provides a jig for surface treatment, which is used for fixing a metal plate having a bearing and performing surface treatment, and comprises a top connecting shaft, a hanging rod, a fixing device, and a bottom connecting shaft. An end of the hanging rod is connected pivotally to the top connecting shaft; the hanging rod passes through the bearing of the metal plate; the fixing device fixes the other end of the hanging rod; and the bottom connecting shaft is connected below the fixing device. For adapting to bearings having various sizes, the jig for surface treatment further comprises an elastic fixing member, which puts around the hanging rod for preventing the metal plate disposed on the hanging rod from sliding. An end of the hang rod escapes from the fixing device and has certain degrees of freedom. For increasing the degrees of freedom of the hanging rod, the top connecting shaft has a pivot part and the hanging rod has a steering mechanism connected pivotally to the pivot part and can be a hinge, a ball joint, or a universal joint. For avoiding the hanging rod having the metal plate escaping from the fixing device, the fixing device has a trench. The hanging rod is wedged in the trench. An end of the hanging rod even has a positioning bump, which is wedged in the trench.

DETAILED DESCRIPTION

In order to make the structure and characteristics as well as the effectiveness of the present disclosure to be further understood and recognized, the detailed description of the present disclosure is provided as follows along with embodiments and accompanying figures.

The present disclosure provides a jig for surface treatment used for fixing a metal plate having a bearing and performing surface chemical processes on the metal plate. Because the jig for surface treatment adopts an axle method for fixing the metal plate, none of components of the jig for surface treatment will contact with a processed surface of the metal plate undergoing surface chemical processes. Thereby, the metal plate will not have apparent flaws caused by scraping, colliding, and sliding by the jig for surface treatment, maintaining completeness of the processed surface of the metal plate after surface treatment. In addition, it is not necessary to add hanging points and hence saving manufacturing procedures and costs.

Figure 1A:
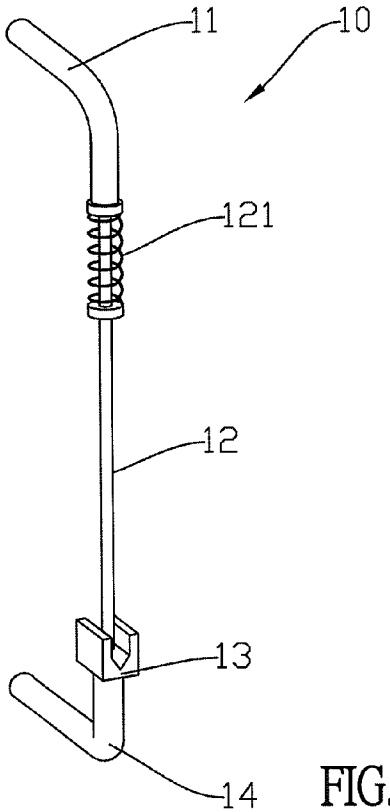
FIG. 1A shows a structural schematic diagram according a first embodiment of the present disclosure.
Figure 1B:
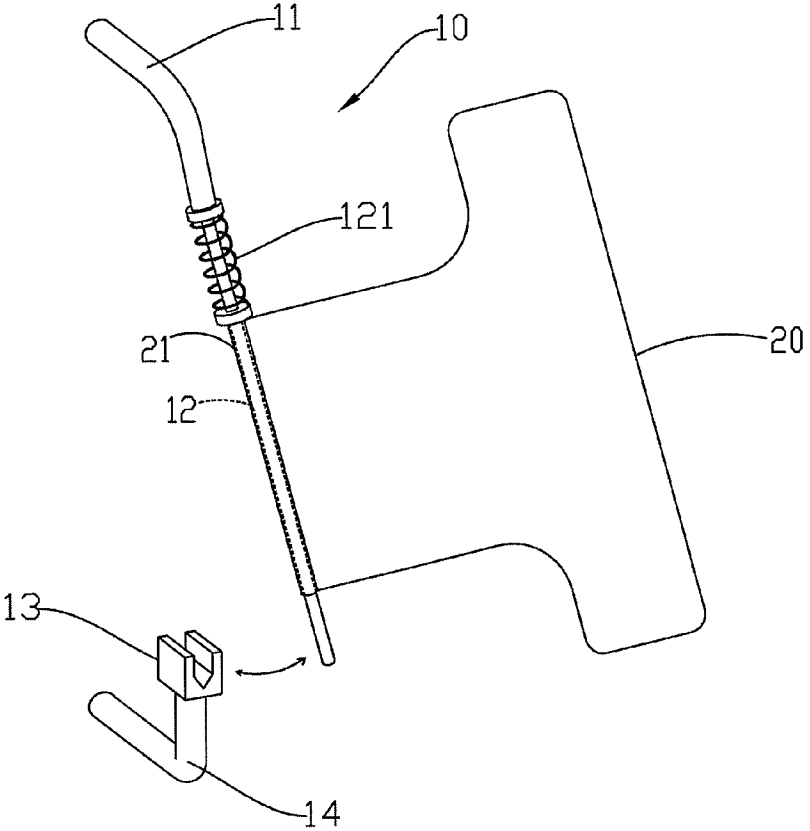
FIG. 1B shows a usage status diagram according a first embodiment of the present disclosure.

FIG. 1A shows a structural schematic diagram according a first embodiment of the present disclosure. As shown in the figure, the jig for surface treatment 10 according to the present disclosure comprises a top connecting shaft 11, a hanging rod 12, a fixing device 13, and a bottom connecting shaft 14. An end of the hanging rod 12 is connected pivotally to the connecting shaft 11; the fixing device 13 is disposed at the bottom connecting shaft 14; and the other end of the hanging rod 12 is wedged in the fixing device 13. Refer also to FIG. 1B, which shows a usage status diagram according a first embodiment of the present disclosure. As shown in the figure, when a metal plate 20 is to be disposed on the jig for surface treatment 10, first make the hanging rod 12 escape from the fixing device 13 and pass through a bearing 21 of the metal plate 20. Then wedge the hanging rod 12 in the fixing device 13. Thereby, the metal plate is fixed on the jig for surface treatment 10 for performing surface chemical processes on the metal plate 20.

The metal plate 20 described above is disposed on the hanging rod 12. The size of the bearing 21 of the metal plate 20 is smaller than the length of the hanging rod 12. The metal plate 20 may slide along the hanging rod 12, and thereby the jig for surface treatment 10 further comprises an elastic fixing member 121 putting around the hanging rod 12. The elastic fixing member 121 can lengthen and shorten elastically according to the size of the bearing 21 and push against the bearing 21 on the fixing device 13 for preventing the metal plate 20 from sliding along the hanging rod 12. The elastic fixing member 121 according to the present embodiment is a spring. The elastic fixing member 121 can also be a rubber block, a silica gel block, or other elastic materials.

Figure 2:
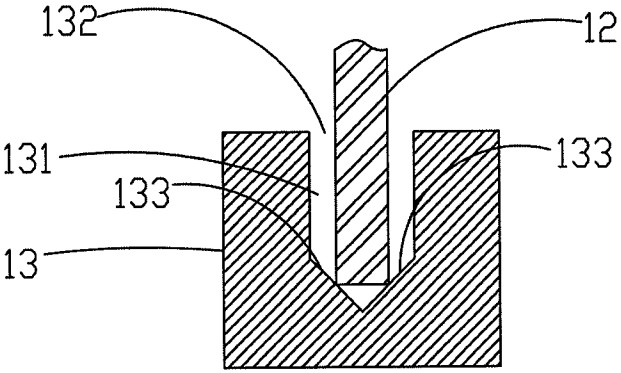
FIG. 2 shows a cross-sectional view of a hanging rod wedged in a fixing device according to a first embodiment of the present disclosure.
Figure 3:
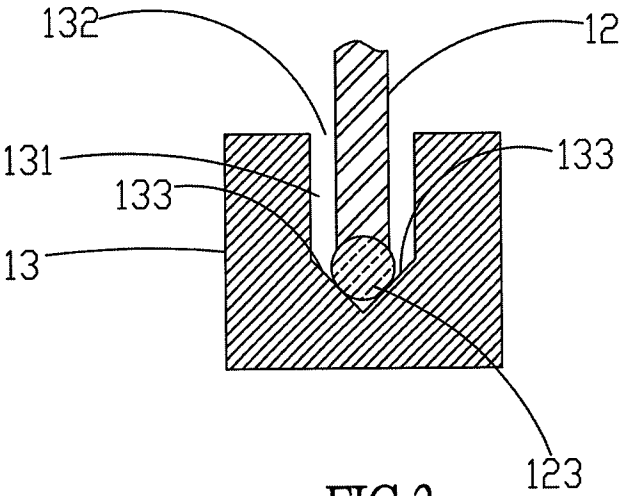
FIG. 3 shows a cross-sectional view of a hanging rod wedged in a fixing device according to a second embodiment of the present disclosure.

FIG. 2 shows a cross-sectional view of a hanging rod wedged in a fixing device according to a first embodiment of the present disclosure. As shown in the figure, the hanging rod 12 is wedged in the fixing device 13, which has a trench 131. The width of the trench 131 shrinks gradually from its opening 132 to the bottom, and thus wedging the hanging rod 12 between two sidewalls 133 of the trench 131. FIG. 3 shows a cross-sectional view of a hanging rod wedged in a fixing device according to a second embodiment of the present disclosure. As shown in the figure, for increasing stability of wedging the hanging rod 12 in the fixing device 13, the end of the hanging rod 12 wedged in the fixing device 13 further has a positioning member 123. According to the present embodiment, the positioning member 123 is a circular bump with a diameter slightly greater than the width of the hanging rod 12. Besides, the contact area between the positioning bump 123 and the two sidewalls 133 of the trench 131 is greater than that between the hanging rod 12 and the two sidewalls 133 of the trench 131. Thereby, the hanging rod 12 is wedged in the fixing device 13 firmly. By applying force to push the hanging rod 12, it can escape from the fixing device 13 with ease. The shape of the positioning member 123 is not limited to the shape described above.

Figure 4:
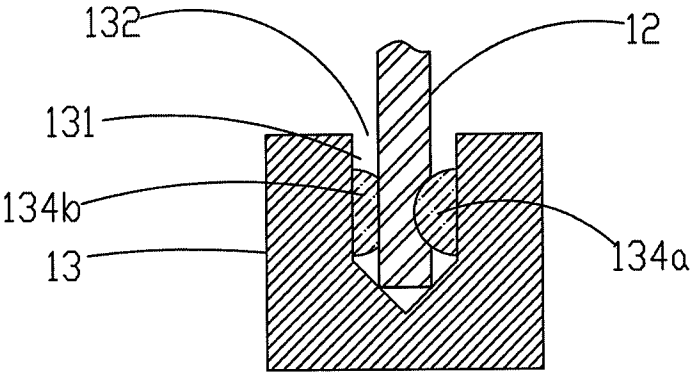
FIG. 4 shows a cross-sectional view of a hanging rod wedged in a fixing device according to a third embodiment of the present disclosure.

FIG. 4 shows a cross-sectional view of a hanging rod wedged in a fixing device according to a third embodiment of the present disclosure. As shown in the figure, the present embodiment provides another fixing method for wedging the hanging rod 12 in the fixing device 13. According to the present embodiment, a first blocking member 134*a* and a second blocking member 134*b* are disposed in the trench 131. When the hanging rod 12 passes through the first blocking member 134*a*, the hanging rod 12 is blocked by the second blocking member 134*b* for avoiding the hanging rod 12 from escaping towards the inner side of the top and the bottom connecting shafts 11, 14. In addition, the hanging rod 12 is also blocked by the first blocking member 134*a* for avoiding the hanging rod 12 from escaping towards the outer side of the top and the bottom connecting shafts 11, 14. The number of the blocking members according to the present disclosure can also be only one. Basically, only the first blocking member 134*a* is required. The first and the second blocking members 134*a*, 134*b* described above can be bumps or protruding pillars. The first to the third embodiments are merely examples for embodying wedging the hanging rod in the fixing device. The present disclosure is not limited to the embodiments. Other disposing methods are still possible, and will not be described in more details here.

Figure 5A:
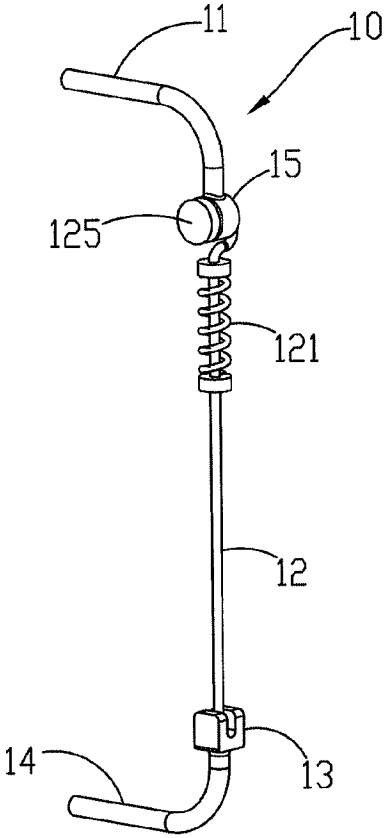
FIG. 5A shows a structural schematic diagram according a fourth embodiment of the present disclosure.
Figure 5B:
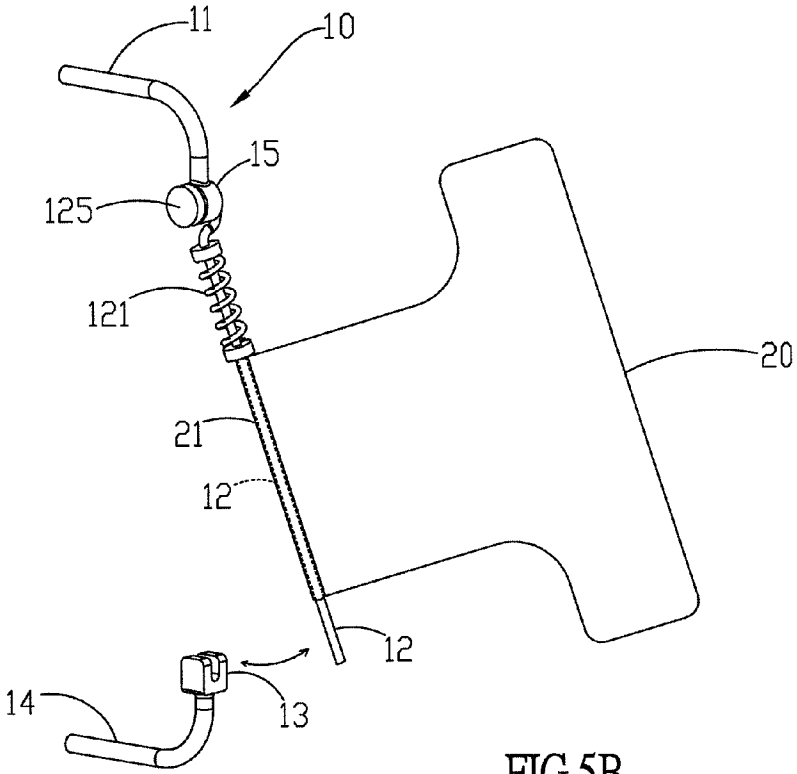
FIG. 5B shows a usage status diagram according a fourth embodiment of the present disclosure.

FIGS. 5A and 5B show a structural schematic diagram and a usage status diagram according a fourth embodiment of the present disclosure. As shown in the figures, the differences between the jig for surface treatment according to the present embodiment and that according to the first embodiment are that according to the present embodiment, a pivot part 15 is disposed at the end of the top connecting shaft 11 connected pivotally with the hanging rod 12, and a steering mechanism 125 is disposed at the end of the hanging rod 12 connected pivotally with the top connecting shaft 11. The steering mechanism 125 is connected pivotally with the pivot part 15. When the hanging rod 12 escapes from the fixing device 13, the hanging rod 12 moves to the position suitable for placing the bearing 21 of the metal plate 20 by means of the steering mechanism 125. When the metal plate 20 is disposed on the hanging rod 12, the hanging rod 12 is wedged in the fixing device 13, and hence disposing the metal plate 20 on the jig for surface treatment 10. The steering mechanism 125 described above can be, but not limited to, a hinge, a ball joint, or a universal joint. According to the present embodiment, a hinge is used for example.

In comparison with the prior art, the jig for surface treatment according to the present disclosure frees itself from traditional surface treatment of materials, in which flaws of clipping points for surface treatment are generated because clipping the only way for fixing. By means of the bearing of the metal plate itself, fixing can be accomplished by axle hanging. In addition to preventing apparent flaws, fixing firmness is maintained and thus the number of loaded metal plates on the jig for surface treatment is increased. Thereby, the throughput of the jig for surface treatment is improved. Please refer to the following embodiment.

Figure 6A:
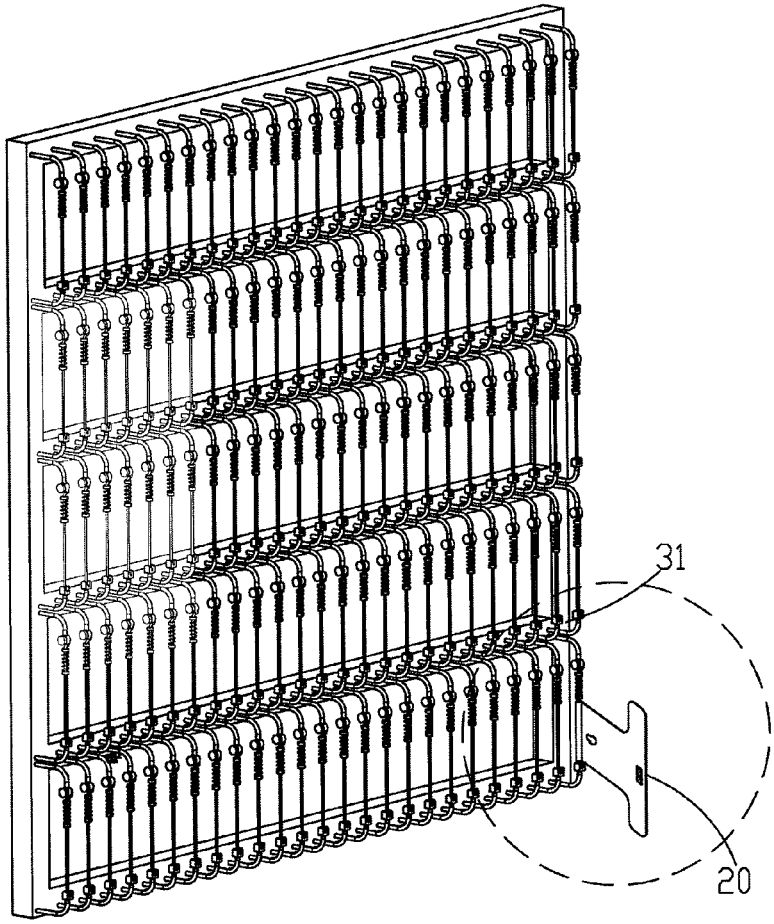
FIG. 6A shows an overall structural schematic diagram according a fifth embodiment of the present disclosure.
Figure 6B:
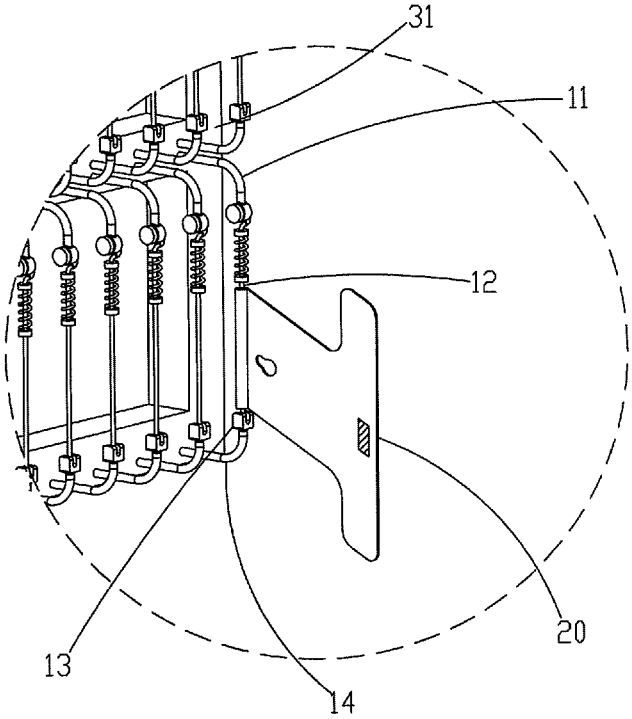
FIG. 6B shows a usage status diagram of hanging a metal plate having a bearing according a fifth embodiment of the present disclosure.

FIGS. 6A and 6B show an overall structural schematic diagram and a usage status diagram of hanging a metal plate having a bearing according a fifth embodiment of the present disclosure. As shown in the figures, the jig for surface treatment 10 according to the present embodiment further comprises a carrying frame 31, which has a plurality of top connecting shafts 11 and a plurality of bottom connecting shafts 14. A hanging rod 12 and a fixing device 13 are disposed between each top connecting shaft 11 and the corresponding bottom shaft 14. The hanging rod 12 is provided for passing through a metal plate 20 and an end thereof is wedged in the fixing device 13. Thereby, the jig for surface treatment 10 according to the present embodiment can accommodate a plurality of metal plates 20 and performing surface chemical processes on the plurality of metal plates 20 simultaneously. Accordingly, the number of loaded metal plates on the jig for surface treatment is increased substantially and hence improving productivity and practicability. Moreover, the plurality of metal plates are fixed vertically, which facilitates fast flowing of chemical solutions during surface chemical processes and avoids collisions between the plurality of metal plates. Thereby, the subsequent processing procedures and costs can be saved.

To sum up, the present disclosure provides a jig for surface treatment, which adopts an axle method for fixing the metal plate on the jig for surface treatment. The metal plate will not contact with a plurality of devices on the jig for surface treatment, and hence avoiding flaws caused by scraping, colliding, or sliding. The jig for surface treatment can dispose a plurality of metal plates at a time and performing surface treatment on the plurality of metal plates simultaneously. Thereby, the number of the loaded metal plates is increased effectively and thus improving productivity and practicability.

Accordingly, the present disclosure conforms to the legal requirements owing to its novelty, nonobviousness, and utility. However, the foregoing description is only embodiments of the present disclosure, not used to limit the scope and range of the present disclosure. Those equivalent changes or modifications made according to the shape, structure, feature, or spirit described in the claims of the present disclosure are included in the appended claims of the present disclosure.

The invention claimed is:

1. A jig used for fixing a metal plate having a bearing, during surface treatment, comprising:

a top connecting shaft;

a hanging rod, having an end connected pivotally to said top connecting shaft;

a fixing device, for fixing the other end of said hanging rod; and a bottom connecting shaft, connected to the bottom of said fixing device;

wherein, said hanging rod passes through said bearing of said metal plate and said hanging rod is fixed by said fixing device during surface treatment, and after surface treatment is completed, and said hanging rod is escaped from said fixing device, which allows for the removal of said metal plate.

2. The jig for surface treatment of claim 1, wherein said top connecting shaft has a pivot part, and an end of said hanging rod is connected pivotally to said pivot part.

3. The jig for surface treatment of claim 2, wherein an end of said hanging rod has a steering mechanism connected pivotally to said pivot part and driving said hanging rod to rotate.

4. The jig for surface treatment of claim 3, wherein said steering mechanism is a hinge.

5. The jig for surface treatment of claim 3, wherein said steering mechanism is a ball joint or a universal joint.

6. The jig for surface treatment of claim 1, wherein said fixing device has a trench and said hanging rod is wedged in said trench.

7. The jig for surface treatment of claim 6, wherein the other end of said hanging rod has a positioning member wedged in said trench.

8. The jig for surface treatment of claim 6, wherein said trench has at least a blocking member for blocking said hanging rod.

9. The jig for surface treatment of claim 1, further comprising an elastic fixing member, the elastic fixing member is put-around said hanging rod for fixing said metal plate.

10. The jig for surface treatment of claim 9, wherein said elastic fixing member is a spring, a rubber block, or a silica gel block.

11. The jig for surface treatment of claim 1, further comprising a carrying frame for disposing said top connecting shaft and said bottom connecting shaft.

12. A jig used for fixing a metal plate having a bearing, during surface treatment, comprising:

a top connecting shaft, having a pivot part;

a hanging rod, having an end, said end of said hand rod having a steering mechanism connected pivotally to said pivot part of said top connecting shaft, said pivot part of said top connecting shaft driving said hanging rod to rotate, and said end of said hanging rod passing through said bearing of said metal plate;

a fixing device, for fixing the other end of said hanging rod; and a bottom connecting shaft, connected to the bottom of said fixing device.

13. The jig for surface treatment of claim 12, wherein said steering mechanism is a hinge.

14. The jig for surface treatment of claim 12, wherein said steering mechanism is a ball joint or a universal joint.

15. The jig for surface treatment of claim 12, wherein said fixing device has a trench and said hanging rod is wedged in said trench.

16. The jig for surface treatment of claiml5, wherein the other end of said hanging rod has a positioning member wedged in said trench.

17. The jig for surface treatment of claim 15, wherein said trench has at least a blocking member for blocking said hanging rod.

18. The jig for surface treatment of claim 17, wherein said elastic fixing member is a spring, a rubber block, or a silica gel block.

19. The jig for surface treatment of claim 12, further comprising an elastic fixing member, the elastic fixing member is put around said hanging rod for fixing said metal plate.

20. The jig for surface treatment of claim 12, further comprising a carrying frame for disposing said top connecting shaft and said bottom connecting shaft.

* * * * *